US012696945B2

(12) United States Patent
Fadida

(10) Patent No.: US 12,696,945 B2
(45) Date of Patent: Aug. 4, 2026

(54) SHIRT OR PRAYER SHAWL WITH REMOVABLE FRINGES

(71) Applicant: Israel Meir Fadida, Ashdod (IL)

(72) Inventor: Israel Meir Fadida, Ashdod (IL)

( * ) Notice: Subject to any disclaimer, the term of this patent is extended or adjusted under 35 U.S.C. 154(b) by 5 days.

(21) Appl. No.: 18/954,704

(22) Filed: Nov. 21, 2024

(65) Prior Publication Data

US 2025/0185738 A1 Jun. 12, 2025

(30) Foreign Application Priority Data

Nov. 26, 2023 (IL) ..... 308869

(51) Int. Cl.
*A41D 27/08* (2006.01)

(52) U.S. Cl.
CPC ..... *A41D 27/08* (2013.01); *A41D 2400/00* (2013.01)

(58) Field of Classification Search
CPC ..... A41B 1/00; A41D 27/08; A41D 27/24; A41D 2400/00; A47G 33/00
See application file for complete search history.

(56) References Cited

U.S. PATENT DOCUMENTS

2008/0271223 A1 11/2008 Cohen
2011/0154555 A1* 6/2011 Messika ..... A41D 1/00 2/115

FOREIGN PATENT DOCUMENTS

IL 251461 10/2018

OTHER PUBLICATIONS

Beth Wood, "How to Sew Flat Piping Trim to a V-neckline", https://weallsew.com/how-to-sew-flat-piping-to-a-v-neckline/ published: May 22, 2017.
Office Action mailed in corresponding IL application 308869 on Nov. 14, 2024.

* cited by examiner

*Primary Examiner* — Sally Haden
(74) *Attorney, Agent, or Firm* — Heidi Brun Associates Ltd.; Heidi M. Brun

(57) ABSTRACT

A four-cornered garment has detachable fringes. The garment includes a piece of clothing with a central cut out for a head and four corners and each corner of the piece of clothing has a slit therein. Each slit includes a first side, a second side, a mitred vertex; and a closure formed of an overlap between the first side and the second side. The closure meets at the mitred vertex. When the closure is closed, the overlap holds one of the detachable fringes in place.

6 Claims, 4 Drawing Sheets

SHIRT OR PRAYER SHAWL WITH REMOVABLE FRINGES

CROSS REFERENCE TO RELATED APPLICATIONS

This application claims priority from IL patent application 308869, filed Nov. 26, 2023, which is incorporated herein by reference.

FIELD OF THE INVENTION

The present invention relates to prayer shawls generally and to undergarment prayer shawls in particular.

BACKGROUND OF THE INVENTION

Observant Jewish males wear a four-cornered fringed garment, known as a "tallit" in Hebrew. There are two types of tallit, one which is worn over clothing and is used during prayer services, and a "tallit katan", or a "little garment", which is worn under clothing, although it can be worn over an undershirt.

FIG. 1 shows an exemplary tallit katan 10, formed of a piece of fabric with a front portion 12 and a back portion 14, and a hole 16 for a head. A fold 18 between front portion 12 and back portion 14 typically sits on the person's shoulders.

Ritually tied to of the corners of each portion are fringes 20, known as "tzitziot" in Hebrew, which have a predefined number of knots and threads. Confusingly, the tallit katan is also sometimes known as a "tzitzit", as its purpose is to hold fringes 20 in place on the person's body.

Fringes 20 are attached to the garment by threading them through a hole 22 in the material at each corner. Hole 22 is typically finished with stitching around the hole and the general area 24 of each corner typically has a double layer of material.

Unfortunately, fringes 20 do not survive for many washes in a washing machine, as they do not have any reinforcement. Moreover, they tend to catch on to other clothing being washed or on parts of the washing machine.

US 2008/271223 teaches an undershirt to which pieces of fabric with fringes connected thereto can be removably connected.

As shown in FIG. 2, to which reference is now briefly made, IL 251461 shows a tallit katan with a hole 30 in a corner thereof and a slit 32 cut from an edge of the garment to hole 30. Slit 32 is shown closed with a zipper, though other types of closure are also discussed. Fringes 34 are connected through hole 30 and may be removed when the zipper is opened.

SUMMARY OF THE PRESENT INVENTION

There is therefore provided, in accordance with a preferred embodiment of the present invention, a four-cornered garment has detachable fringes. The garment includes a piece of clothing with a central cut out for a head and four corners and each corner of the piece of clothing has a slit therein. Each slit includes a first side, a second side, a mitred vertex; and a closure formed of an overlap between the first side and the second side. The closure meets at the mitred vertex. When the closure is closed, the overlap holds one of the detachable fringes in place.

Moreover, in accordance with a preferred embodiment of the present invention, the slit is vertical or horizontal.

Further, in accordance with a preferred embodiment of the present invention, the slit defines a flap over which a set of fringes is loopable.

Moreover, in accordance with a preferred embodiment of the present invention, when the closure is closed, a first lower edge of the first side and a second lower edge of the second side are aligned.

Further, in accordance with a preferred embodiment of the present invention, the garment also includes a first closing element and a second closing element. The first element and the second element are located close to the first and second lower edges.

Finally, in accordance with a preferred embodiment of the present invention, the piece of clothing is an undershirt or T-shirt.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
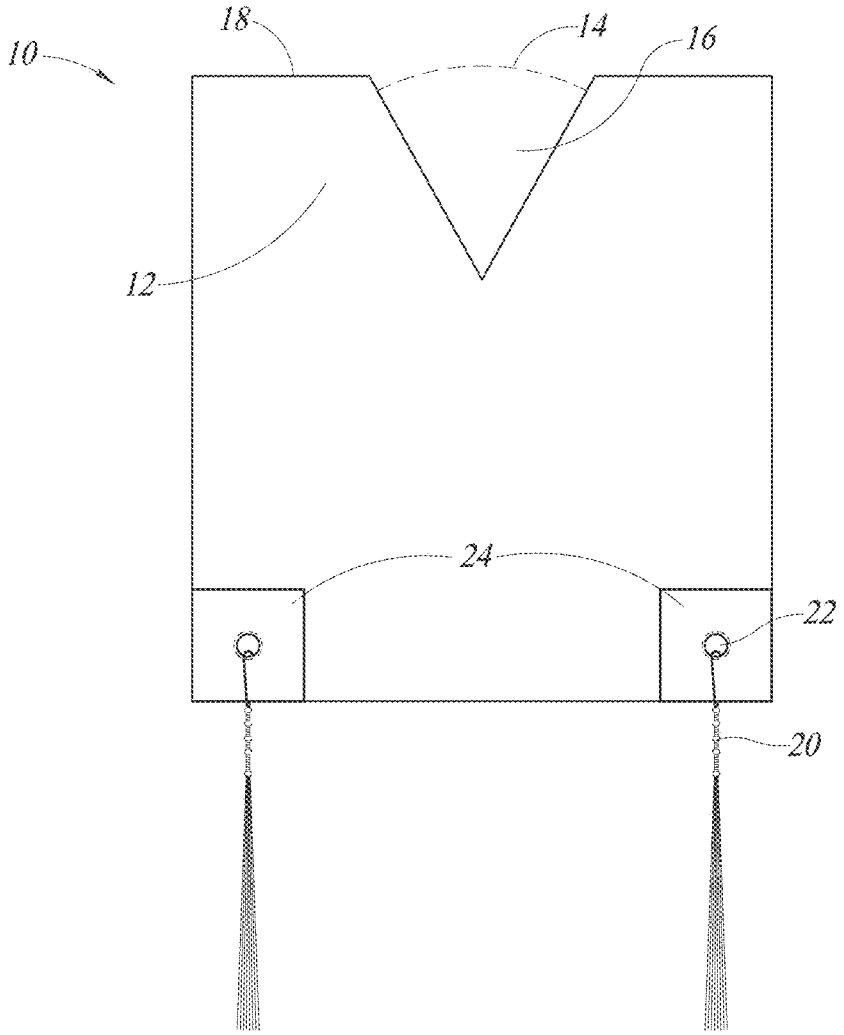
FIG. 1 PRIOR ART
FIG. 1 is an exemplary prior art illustration of a four-cornered garment or "tallit katan"
Figure 2:
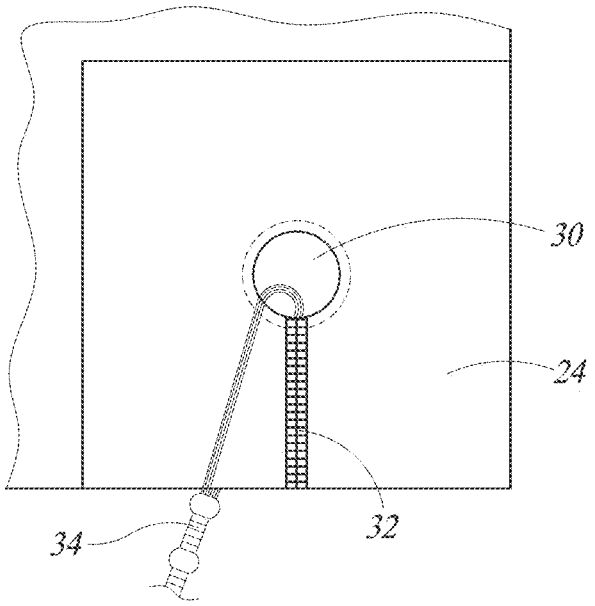
FIG. 2 PRIOR ART
FIG. 2 is an exemplary prior art illustration of a corner with a hole and slit closed with a zipper to the hole.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Figure 3:
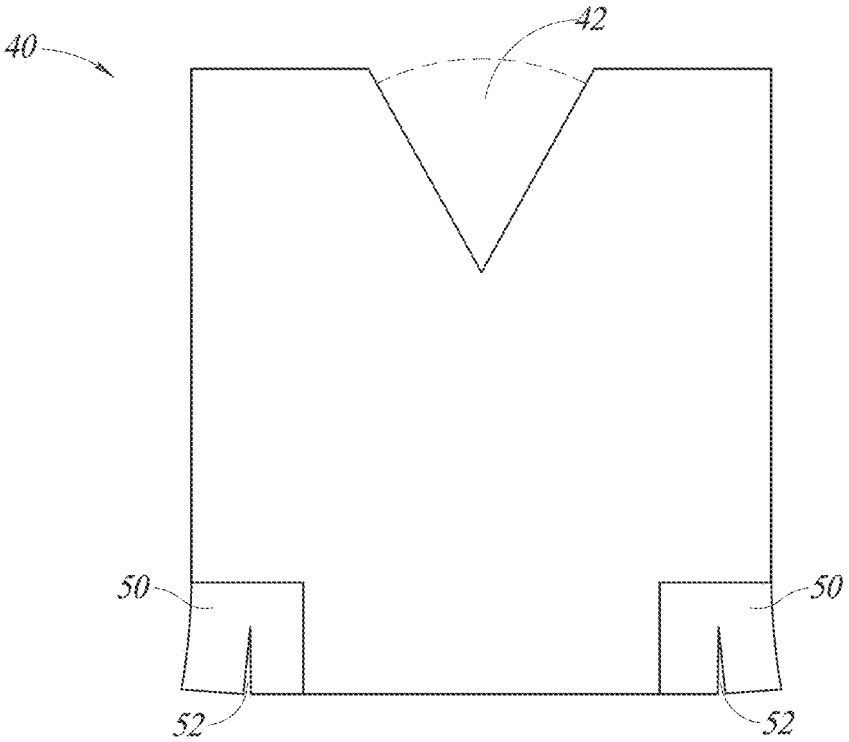
FIG. 3 is a schematic illustration of a four-cornered garment with corners with slits therein, constructed and operative in accordance with a preferred embodiment of the present invention.

Reference is now made to FIG. 3, which illustrates an exemplary four-cornered garment 40, or "tallit katan", comprising a four-cornered rectangular piece of clothing with a central cut out 42 for a head and four corners 50 to hold its fringes. Applicant has realized that each fringe may be slid on and off of its corner through a slit 52 in its corner, to allow for easy removal of the fringes before being laundered, such as by a washing machine.

Figure 4A:
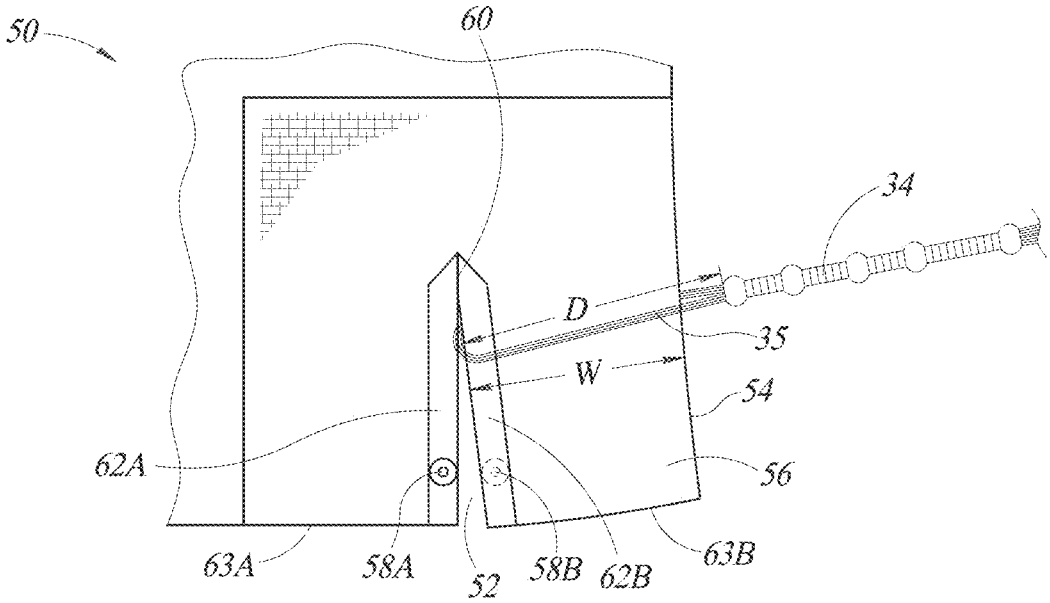
FIGS. 4A, 4B and 4C are schematic illustrations which show three states of one exemplary corner of the four-cornered garment of FIG. 3.
Figure 4B:
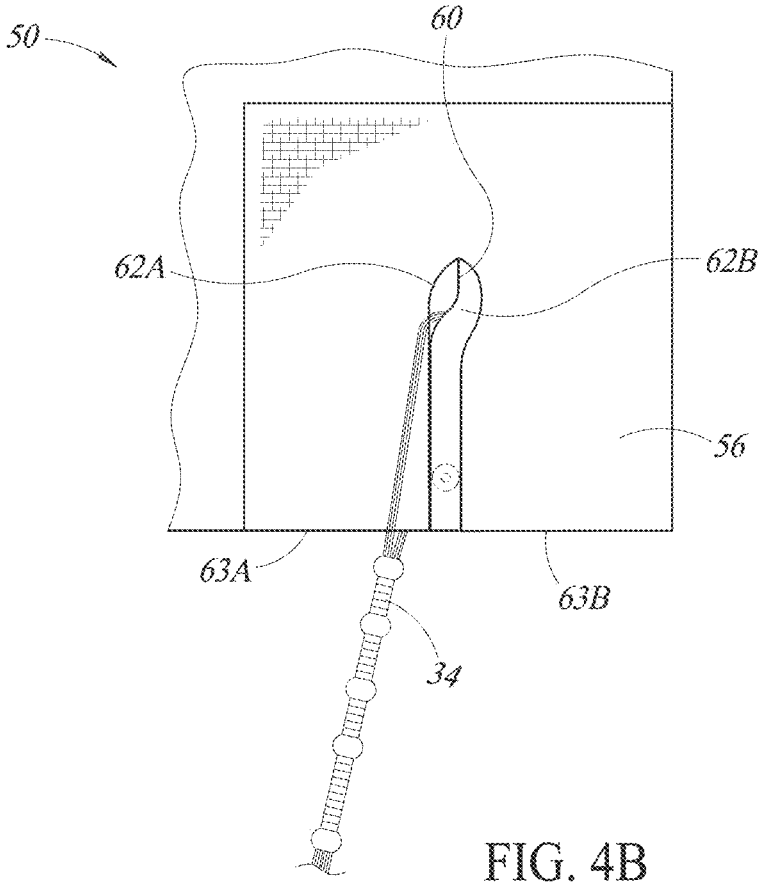
Figure 4C:
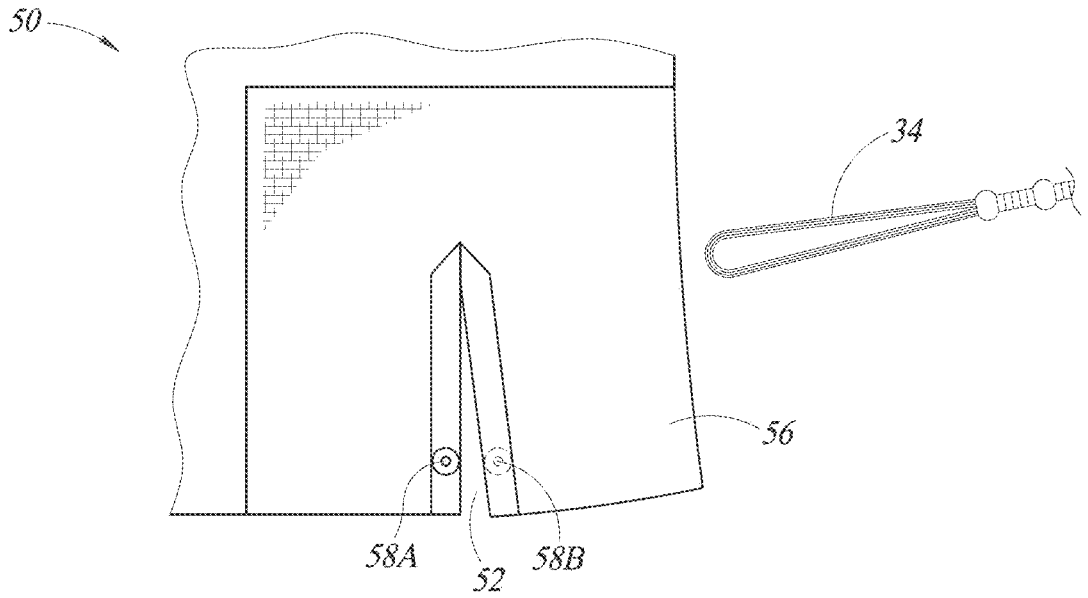

Reference is now made to FIGS. 4A, 4B and 4C, which show three states of one exemplary corner 50 of the inventive four-cornered garment. Corner 50 may comprise its slit 52 close to a vertical edge 54 of the garment, creating a flap 56 between slit 52 and vertical edge 54. As shown in FIG. 4A, fringes 34 may be slid or looped over flap 56.

Applicant has further realized that the sliding of fringes 34 in and out of slit 52 may rub the edges of slit 52, and that covering the slit with a binding 62, such as a bias binding, rather than a simple seam finish, may provide much stronger reinforcement against such rubbing. Binding 62 may comprise a first binding portion 62A covering the left side of slit 52, a second binding portion 62B covering the right side of slit 52, and a vertex 60 between bindings 62A and 62B.

Corner 50 may also comprise a closure 58, such as a snap, a fastener or a piece of a hook and loop fastener such as a VELCRO® hook and loop fastener. Closure 58 may comprise one element 58A on binding portion 62A and a second element 58B on binding portion 62B.

Applicant has further realized that, if binding 62 turns with a mitred corner at vertex 60 (i.e., folded to reduce bulk and so that the binding portion 62A meets binding portion 62B at a 45 degree angle at vertex 60), then, after sliding fringes 34 into slit 52, binding portion 62B may be folded to lie generally directly over binding portion 62A, as shown in FIG. 4B. Using closure elements 58A and 58B, binding portion 62B may be fastened to binding portion 62A, thereby closing slit 52 around fringes 34 and holding them in place between closure 58 and vertex 60. FIG. 4B shows fringes 34 hanging vertically down, as they will be when they are worn.

It will be appreciated that, as a result of this folding, a lower edge 63A of corner 50 and a lower edge 63B of flap 56 may be become aligned. Alternatively, when closure 58 is closed, the lower edges of binding portions 62A and 62B may be aligned. Both embodiments enable corner 50 to have a straight lower edge, as required, despite having slit 52 therein. Closure elements 58A and 58B may be located close to lower edges 63A and 63B, respectively, to help lower edges 63A and 63B remain aligned.

Upon opening closure 58, fringes 34 may be slid off of flap 56, as shown in FIG. 4C. In this manner, fringes 34 are kept out of the washing machine.

Applicant has also realized that manufacture of the inventive four-cornered garment of the present invention may be significantly simpler than of prior art garments. The latter require finishing four holes and then tying each fringe directly in its corner. However, in the present invention, Applicant has also realized that, with detachable fringes, the manufacturing process is much simpler. There are no holes and the detachable fringes are held in place via the overlap rather than via a hole.

In one exemplary embodiment, flap 56 may have an exemplary width W of 5 cm and fringes 34 may have a loop 35 with an exemplary diameter D of 6.5 cm. Other widths and diameters are possible.

Figure 5:
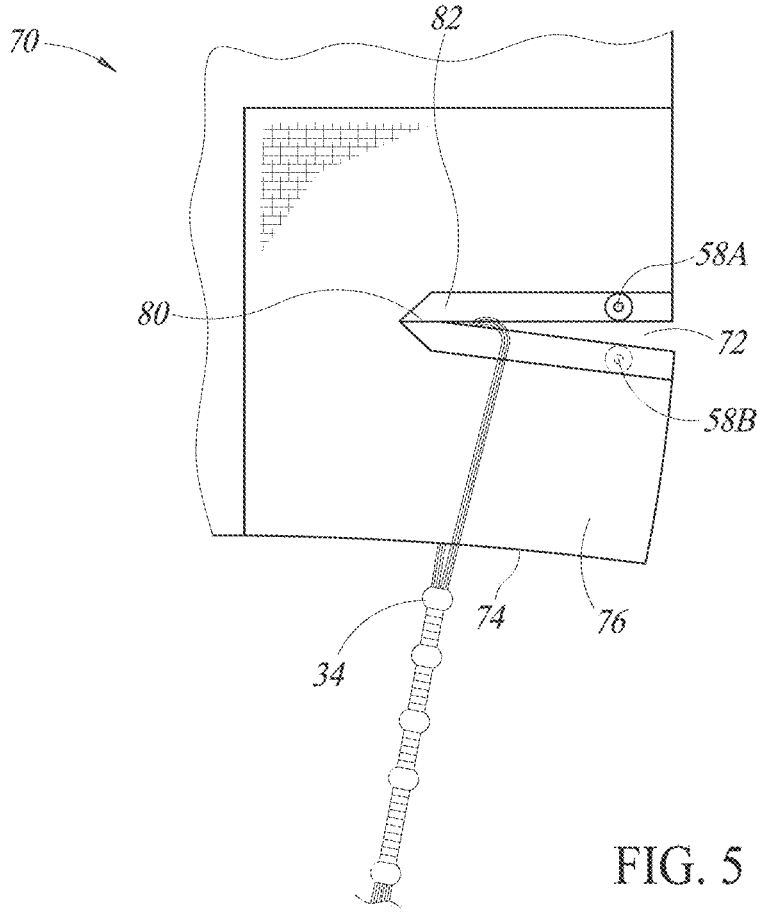
FIG. 5 is a schematic illustration of an alternative embodiment of the four-cornered garment of FIG. 3 which has a corner with a horizontal slit.

Reference is now made to FIG. 5, which illustrates an alternative embodiment of the present invention. In this embodiment, the corner, here labeled 70, may comprise a horizontal slit 72, close to a horizontal edge 74 of the garment, creating a flap 76 between slit 72 and horizontal edge 74. Fringes 34 may be slid on over flap 76 and then fastened in slit 72 using any of the closure elements 58 discussed hereinabove. Note that, in this embodiment, fringes 34 may be slid on and may hang vertically.

In this embodiment, as in the previous embodiment, slit 72 may be finished with a binding 82 with a mitred vertex 80.

In a further alternative embodiment, four-cornered garment 40 may be formed from an undershirt or T-shirt, whose lower side seams are unsewn so as to provide four corners 50 to hold its fringes.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A corner of a tallit katan-having detachable fringes,
wherein the corner has a slit therein and the slit comprises the following:
a first side, a second side and a mitred vertex; and
a closure formed of an overlap between said first side and said second side and meeting at said mitred vertex,
wherein, when said closure is closed, said overlap holds said detachable fringes in place, and
wherein said closure comprises a first closure element located close to a first lower edge of said first side and a second closure element located close to a second lower edge of said second side.

2. The corner according to claim 1 wherein said slit is vertical.

3. The corner according to claim 1 wherein said slit is horizontal.

4. The corner according to claim 1 and wherein said slit defines a flap over which said detachable fringes is loopable.

5. The corner according to claim 1 and wherein when said closure is closed, said first lower edge and said second lower edge are aligned.

6. The corner according to claim 1 forming part of an undershirt or a T-shirt.

* * * * *